US012383808B2

(12) United States Patent
Glasgow, Jr.

(10) Patent No.: US 12,383,808 B2
(45) Date of Patent: Aug. 12, 2025

(54) MULTIPOCKETED GOLF CLUB COVERING

(71) Applicant: Walter M. Glasgow, Jr., Weatherford, TX (US)

(72) Inventor: Walter M. Glasgow, Jr., Weatherford, TX (US)

(73) Assignee: Walter M. Glasgow, Jr., Weatherford, TX (US)

( * ) Notice: Subject to any disclaimer, the term of this patent is extended or adjusted under 35 U.S.C. 154(b) by 113 days.

(21) Appl. No.: 18/373,783

(22) Filed: Sep. 27, 2023

(65) Prior Publication Data

US 2025/0099828 A1 Mar. 27, 2025

(51) Int. Cl.
*A63B 60/62* (2015.01)

(52) U.S. Cl.
CPC ..... *A63B 60/62* (2015.10)

(58) Field of Classification Search
CPC ..... A63B 60/62
USPC ..... 150/160; 206/315.4
See application file for complete search history.

(56) References Cited

U.S. PATENT DOCUMENTS 9,839,825 B1 * 12/2017 Watkins ..... A63B 60/62
10,478,692 B2 * 11/2019 Gotshall ..... A63B 60/62
2002/0108689 A1 * 8/2002 Kloos ..... A63B 60/62 150/160
2004/0144460 A1 * 7/2004 German ..... A63B 60/62 150/160
2007/0152004 A1 7/2007 Rooney
2008/0256734 A1 10/2008 Bratcher et al.
2009/0151105 A1 6/2009 Bohannon et al.
2014/0259492 A1 9/2014 Salisbury, Sr.
2015/0232040 A1 8/2015 Wirtjes

FOREIGN PATENT DOCUMENTS

EP 2361123 1/2014

* cited by examiner

*Primary Examiner* — Sue A Weaver
(74) *Attorney, Agent, or Firm* — C. Tumey Law Group, PLLC

(57) ABSTRACT

In general, in one aspect, embodiments relate to a multipocketed covering that includes a first section that includes a first pocket disposed within one or more fabrics for receiving a first golf clubhead, and at least a second section that includes a second pocket disposed within the one or more fabrics for receiving a second golf clubhead, where the first section and the second section are adjoined between the first pocket and the second pocket, where the multipocketed covering is foldable along at least a length of the multipocketed covering by one or more folds, where the one or more folds allow the multipocketed covering to meanderingly extend across at least the first and the second golf clubs to prevent frictional engagement between at least the first golf clubhead and the second golf clubhead.

18 Claims, 5 Drawing Sheets

MULTIPOCKETED GOLF CLUB COVERING

BACKGROUND

Golf players face various challenges when it comes to protecting their equipment. When transporting golf clubs with a golf bag, for example, the golf clubheads may collide, clash, rub against, interact, or otherwise frictionally engage with each other, shafts or hosels of other golf clubs, and/or other objects. These frictional interactions may cause damage to the golf clubs, for example, causing them to incur scratches, dents, scuffs, scrapes, etc. In addition to diminishing the aesthetic of the clubheads, this damage may also impact the clubs' performance as more serious defects to the clubfaces may interfere with the trajectory of a golf ball when a golf player later impacts the golf ball with the clubface. Traditional solutions to this problem involve separately encasing each individual clubhead with a head cover. However, these head covers are typically large and bulky, and are difficult to keep track of as numerous covers are required for a full set of clubs.

SUMMARY

Disclosed herein is an example multipocketed covering. The multipocketed covering comprises a first section comprising a first pocket disposed within one or more fabrics for receiving a first golf clubhead. The multipocketed covering also comprises at least a second section comprising a second pocket disposed within the one or more fabrics for receiving a second golf clubhead. The first section and the second section are adjoined between the first pocket and the second pocket. The multipocketed covering is foldable along at least a length of the multipocketed covering by one or more folds, where the one or more folds allow the multipocketed covering to meanderingly extend across at least the first and the second golf clubs to prevent frictional engagement between at least the first golf clubhead and the second golf clubhead.

Also disclosed herein is an example method of manufacturing a multipocketed covering. The method comprises folding one or more fabrics and sewing the one or more fabrics. The method may also comprise, after folding the one or more fabrics and at least partially sewing the one or more fabrics, punching one or more holes in the one or more fabrics, and placing one or more hanging devices in the one or more holes for hanging the multipocketed covering from a golf bag.

It is to be understood that both the foregoing general description and the following detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following detailed description.

BRIEF DESCRIPTION OF THE DRAWINGS

These drawings illustrate certain aspects of some of the embodiments of the present invention and should not be used to limit or define the invention.

DETAILED DESCRIPTION

Figure 1:
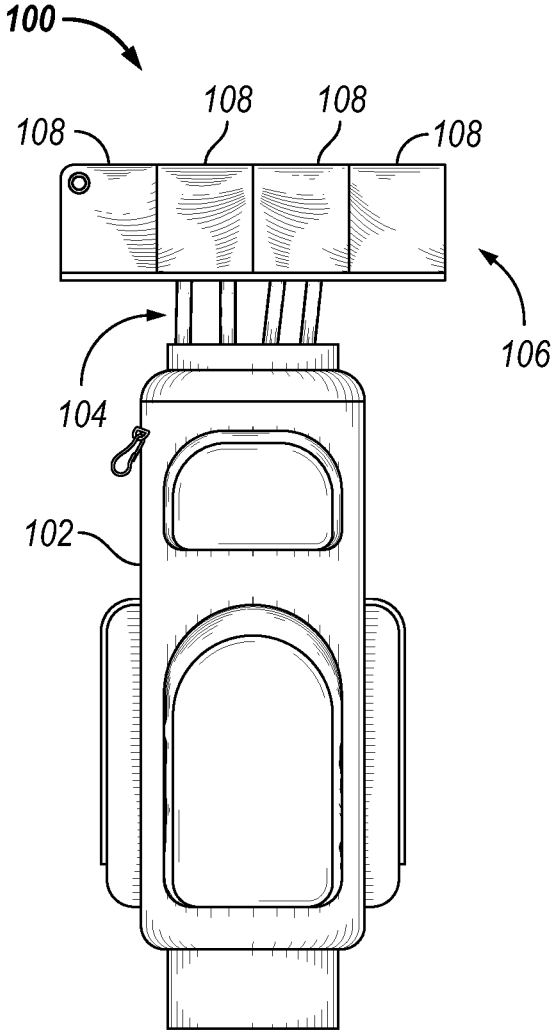
FIG. 1 shows a golf bag and golf clubs having a multipocketed covering in accordance with one or more embodiments of the present disclosure.

It is to be understood that the present disclosure is not limited to particular systems or compositions which may, of course, vary. It is also to be understood that the terminology used herein is for the purpose of describing particular embodiments only and is not intended to be limiting. All numbers and ranges disclosed herein may vary by some amount. Whenever a numerical range with a lower limit and an upper limit is disclosed, any number and any included range falling within the range are specifically disclosed. Although individual embodiments are discussed herein, the invention covers all combinations of all those embodiments. As used herein, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected. If there is any conflict in the usages of a word or term in this specification and one or more patent or other documents that may be incorporated herein by reference, the definitions that are consistent with this specification should be adopted for the purposes of understanding this invention.

Disclosed herein are apparatuses to be used in conjunction with golf equipment. More particularly, disclosed herein is a multipocketed covering comprising a single fabric, or a plurality of fabrics, within which a plurality of pockets may be disposed for receiving a plurality of golf clubheads. The present disclosure provides a multipocketed covering which protectively insulates the golf clubheads and reduces the risk of damage to the clubheads and/or shafts/hosels attached thereto caused by interactions between the clubs.

Specifically, the multipocketed covering may be fitted over a plurality of golf clubheads, with each golf clubhead of the plurality disposed within a pocket of a corresponding section of the multipocketed covering. Use in this manner prevents the golf clubheads from clashing into each other or other objects, such as during travel or routine use, e.g., walking/driving on a golf course. In some examples, where the shaft of a golf club comprises graphite, the multipocketed covering may additionally serve to protect the shaft from neighboring clubheads.

In some examples, the multipocketed covering may also mitigate any damages that would otherwise be incurred as a result of elemental exposure, e.g., to rain, heat, etc. For example, for painted clubs, the photobleaching effect of solar radiation may be reduced or eliminated by the multipocketed covering. In addition, or alternatively, the multipocketed covering may weatherproof the clubheads by limiting their exposure to rain or may function to dry the clubs when they are exposed to water.

In one or more embodiments, the multipocketed covering has the dual function of serving as both a protective covering as well as a golf towel. Golf towels are used to clean equipment (e.g., the golf clubs, golf balls, etc.), or a golfer (e.g., to wipe away sweat, etc.). The multipocketed covering of the present disclosure may be removed from a plurality of golf clubs during play, and subsequently used to wipe off equipment, a player's face, etc. Moreover, in some examples, the multipocketed covering may be hung from a golf bag where it is easily retrievable during play.

FIG. 1 shows a system 100 comprising a golf bag 102 and golf clubs 104 having a multipocketed covering 106 in accordance with one or more embodiments of the present disclosure. System 100 comprises a golf bag 102, golf clubs 104, and a multipocketed covering 106. As mentioned, the multipocketed covering 106 may cover a plurality of golf clubheads (e.g., heads 206 of FIG. 2). Specifically, the multipocketed covering 106 comprises a plurality of pockets within which each of the golf clubs 104 are inserted. The pockets, to be shown in later figures, serve to house the golf clubheads, and may be loosely or tightly (e.g., elastically) disposed about at least the heads of golf clubs 104. In one or more examples, the shape and/or size of each of the pockets may be one-size-fits-all, or else may be specifically adapted to fit one or more types of the golf clubs 104.

Figure 2:
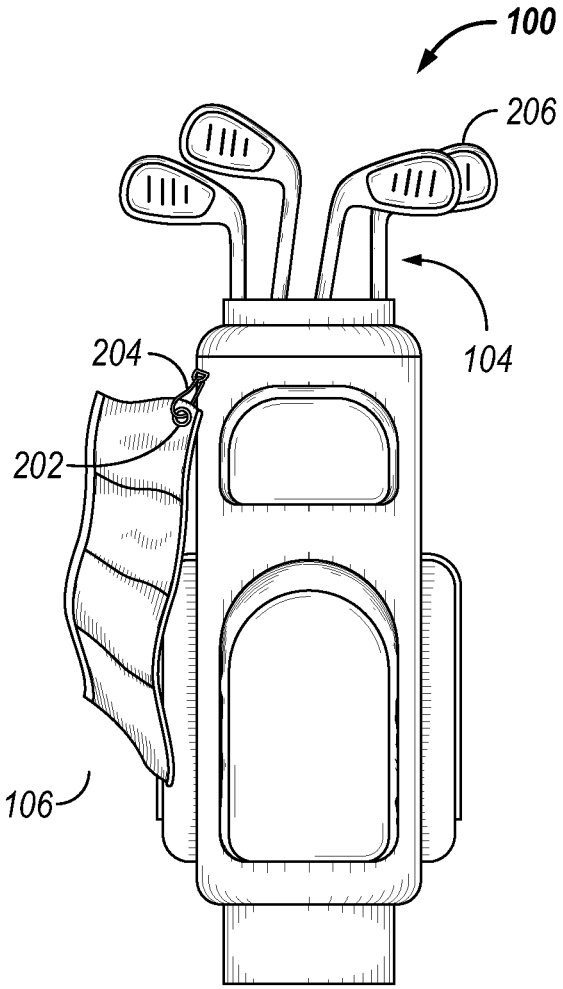
FIG. 2 shows the golf bag and golf clubs of FIG. 1 with a multipocketed covering hanging from the golf bag by a grommet in accordance with one or more embodiments of the present disclosure.

FIG. 2 shows the golf bag 102 and golf clubs 104 of FIG. 1 with the multipocketed covering 106 hanging from the golf bag 102 by a grommet 202 in accordance with one or more embodiments of the present disclosure. The grommet 202 essentially allows a player to hang the multipocketed covering 106 from the golf bag 102 when the multipocketed covering 106 is not disposed around the golf clubs 104, for example, after a player has removed one or more of the golf clubs 104 from the golf bag 102 during play on a golf course. This gives the player easy access to the multipocketed covering 106 when it is being used as a golf towel. In the illustrated example, the grommet 202 has a center hole, which is used to hang the multipocketed covering 106 on a corresponding hanging feature (e.g., a hook, protrusion, knob, hook-and-loop fastener, carabiner, etc.) of the golf bag 102. While shown as a grommet, grommet 202 may alternatively comprise one or more various other types of attachment devices such as a clip, a snap fit, a cloth loop, a hook and loop fastener (e.g., Velcro), a buckle, an eyelet, and the like, for hanging on a corresponding feature of the golf bag 102. The corresponding hanging feature comprises a hook 204 in FIG. 2, however may be substituted with any suitable device for receiving/mating with the grommet 202. The grommet 202 on the multipocketed covering 106 may attach, snap, buckle, or otherwise attach or fasten to a corresponding hanging feature of the golf bag 102, thereby allowing the multipocketed covering 106 to hang off the side of the golf bag 102 during use. Also shown in this figure are the clubheads 206 of the golf clubs 104, which may comprise, for example, any of one or more wedges, irons, hybrids, putters, drivers, a fairway wood, and combinations thereof.

Figure 3A:
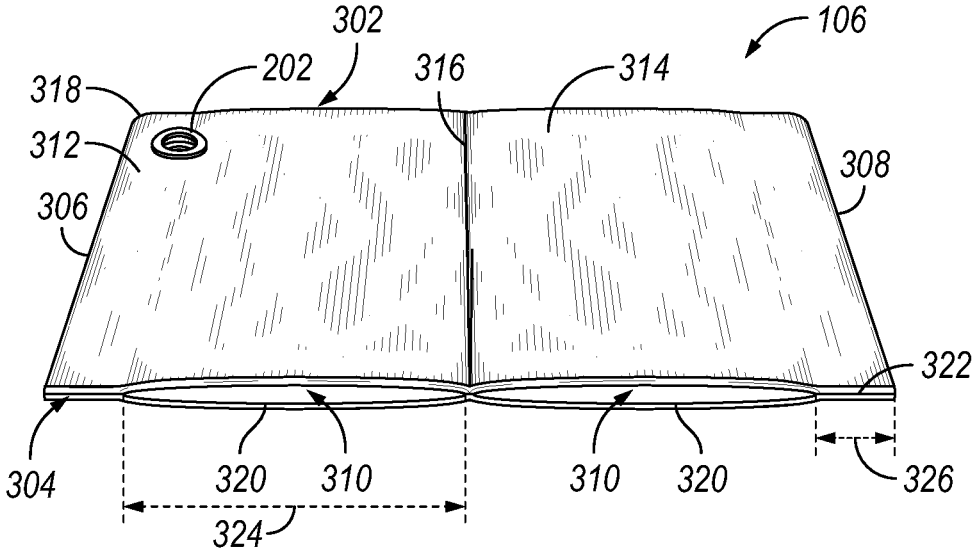
FIG. 3A is a side view of a multipocketed covering in accordance with one or more embodiments of the present disclosure.

FIG. 3A is a side view of the multipocketed covering 106 in accordance with one or more embodiments of the present disclosure. In the figure, the top side 302 is the northern-most side of the multipocketed covering 106. The bottom side 304 is the southern-most side of the multipocketed covering 106. The left side 306 is the western-most side of the multipocketed covering 106, and the right side 308 is the eastern-most side of the multipocketed covering 106. The multipocketed covering 106 is depicted in this figure as having a first section 312 and a second section 314 with a corresponding pocket 310, however may alternatively comprise any suitable number of sections and respective pockets, for example, two, three, four, five, six, seven, fourteen, etc., sections and/or pockets. In the illustrated example, each pocket is joined to the adjacent section by a seam 316. The seam may be, for example, a straight stitch, backstitch, blind stitch, whip stitch, buttonhole stitch, cross-stitch, chain stich, zigzag stitch, running stitch, satin stitch, overlock stitch, lockstitch, machine stitch, etc., or any suitable type of stitching. Alternatively, seam 316 may be replaced with other suitable means of adjoining the sections 312, 314, for example, fabric glue, heat bonding, fusible interfacing, sewing tape, fabric tape, hook-and-loop fasteners, grommets, snaps and buttons, fabric rivets, knotting, tying, combinations thereof, or the like.

Also visible in this figure is the grommet 202. As illustrated, the grommet 202 may be disposed at or near an edge of the multipocketed covering 106, for example, near (e.g., within 0.5, 1, or 2 inches or less) a top left corner 318 of the multipocketed covering 106. Alternatively, a right left corner, bottom right corner, or bottom left corner. Yet alternatively, along or near a top, left, right, or bottom edge 302, 304, 306, or 308 of multipocketed covering 106, such as near or at a seam 316. One or more of the corners (e.g., 318) may be round, as illustrated, or sharp/square. In one or more examples, multiple grommets may be used, such that a plurality of grommets may be used to hang from a plurality of corresponding hanging features.

As illustrated, the pockets 310 of the multipocketed covering 106 may be accessible via openings 320. Each of the openings 310 allow for inserting one of a plurality of golf clubs 104 into a respective pocket 310 of the multipocketed covering 106. As illustrated in this figure, the openings 320 are disposed at the bottom edge 304 of the multipocketed covering 106 in a configuration such that an opening of the first section 312 is directly adjacent to or near an opening of the second section 314. However, openings of each section may be configured in various alternative arrangements, such as by being centrally aligned about a vertical centerline of each section, or else separated by a seam or fold (not shown) along the bottom edge 304 between openings 320. Also visible in this figure is a bottom seam 322 which may serve to further enclose at least a portion of one or more of the sections 312, 314 to maintain isolation between the pockets 310 and the external environment without the multipocketed covering 106. Where used, one or more bottom seams 322 may narrow the openings 320 by restricting the length(s) 324 thereof. This may allow, in some examples, for the pockets 310 to fit snugly around the heads 206 (e.g., referring to FIG. 2) and prevent the multipocketed covering 106 from prematurely dislodging from the golf clubs 104.

One or more of the openings 310 may have a length 324 of about 3 inches (7.62 cm). Alternatively, from about 2 inches (5.08 cm) to about 5 inches (12.7 cm), or any ranges therebetween. The length 324 of the openings 310 may be adapted for a particular type of clubhead 206 (e.g., referring to FIG. 2). In some examples, a length 324 of the first section 312 may be a first length adapted for a first type of golf club or clubhead, e.g., wedge, and a length of another section of a multipocketed covering 106 being adapted for a second type of golf club or clubhead, e.g., a driver. However, it should be noted that oftentimes, one golf club may be taller than another, for example, a driver may be taller than a wedge. Thus, the multipocketed covering 106 may be used to cover a subset of clubs of a full set of golf clubs, for example, a subset having the same or similar heights.

Similarly, one or more of the bottom seams 322 of any one section of a multipocketed covering 106 may have a length 326 of about 2 inches (5.08 cm). Alternatively, from about 0 inches to about 3 inches (7.62 cm), or any ranges therebetween. Where a multipocketed covering 106 has more than two sections, e.g., referring to FIGS. 4, 5, and 6, a bottom seams of one section and a bottom seam of another section adjacent to the first (e.g., adjacent at seam 408 of FIG. 4) may have a combined length of about 4 inches, for example. Such combined length of bottom seams may vary in various of the configurations, for example, when the openings are in a left-right-left alternating configuration, right-left-right alternating configuration, centralized configuration, or other configuration to be shown and discussed in later figures.

The pockets 310 may be directly formed by the one or more fabrics that make-up the multipocketed covering 106 (e.g., outer region thereof), or alternatively, may be formed by one or more additional fabrics, e.g., lining, disposed within the multipocketed covering 106. Use in this latter configuration may allow, in some examples, for the size of the pockets 310 to be adapted to suit a particular type of club and may allow the pockets 310 to be smaller than their respective sections 312, 314. In one or more examples, the size (i.e., internal volume) of the pockets 310 may vary, for example, wherein a first pocket has a first size to suit a first type of club or clubhead, and wherein a second pocket has a second size to suit a second type of club or clubhead. The interior of each pocket 310 may comprise the same or a different type of fabric used for the outer region of the multipocketed covering 106. For example, the interior of each pocket 310 may comprise insulating fabric, cushioning fabric, padding, or the like.

Any of the top, left, right, and bottom edges 302, 304, 306, 308, or any materially feasible combination thereof, may comprise at least one of a seam, seam allowance, or a fold. Where used, one or more seams, seam allowances, and/or folds may allow for ease of manufacture of the multipocketed covering 106. In addition, while not shown, one or more snaps, buckles, drawstrings, fasteners, clips, etc., or other suitable fastening mechanism may be disposed at or near the bottom edge 304, such as at or within the opening 320 of one or more of the sections 312, 314. In such examples, a golf player may reconfigure (e.g., close, snap, tighten, etc.) an opening 320 of one or more of the sections around at least a portion of a club 104 (e.g., referring to FIG. 1) such that once inserted within a pocket, a golf clubhead 206 (e.g., referring to FIG. 2) is kept from coming loose from the multipocketed covering 106. For example, a drawstring or buckle may be used to constrict an opening 320 around a hosel, shaft, ferrule, etc., of golf club when the clubhead 206 is disposed in a pocket 310.

Figure 3B:
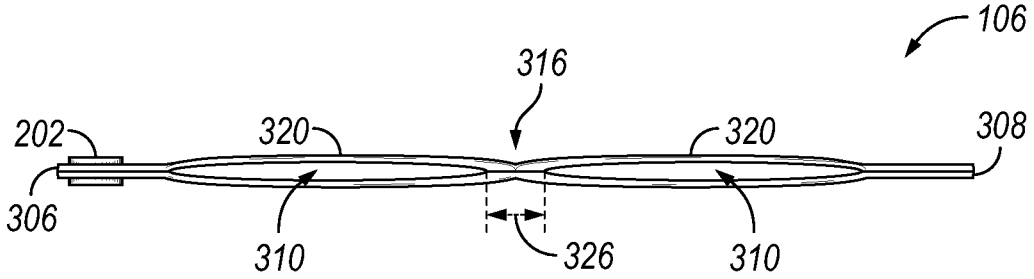
FIG. 3B is a bottom view of the multipocketed covering of FIG. 3A in accordance with one or more embodiments of the present disclosure.

FIG. 3B is a bottom view of the multipocketed covering 106 of FIG. 3A free of any golf clubs, in accordance with one or more embodiments of the present disclosure. This view illustrates how the first section 312, and the second section 314 may be adjoined by a seam 316. Also visible in this figure is how a distance 326 may separate the openings 320, which may be a distance equal to or greater than that of the seam 316 itself. Towards the left and right edges 306, 308, the multipocketed covering 106 may narrow as illustrated, such as when pockets 310 comprise additional fabric. Alternatively, no narrowing may be present if, for example, the pockets 310 do not comprise additional fabric. Also visible in this view is the grommet 202, which is located near the left edge 306. In one or more examples, rather than a seam 316, fabric glue, heat bonding, fusible interfacing, sewing tape, fabric tape, hook-and-loop fasteners, snaps and buttons, fabric rivets, knotting, tying, or any combinations thereof may be used to adjoin first and second sections 312, 314 instead of a seam 316.

Figure 3C:
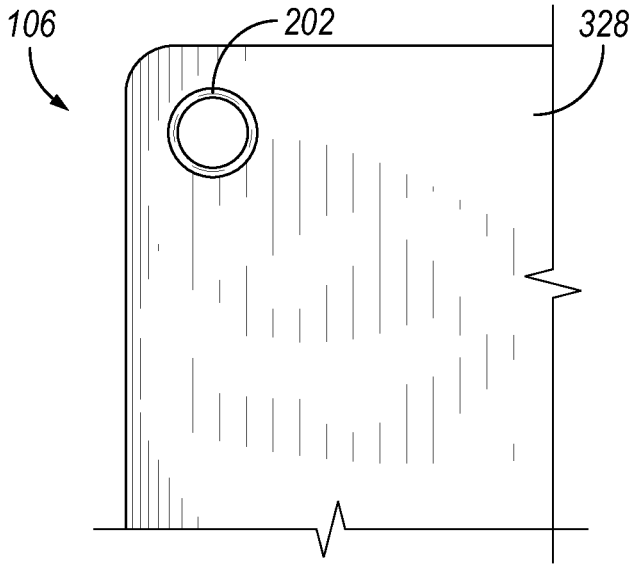
FIG. 3C is a close-up view of a grommet shown in FIGS. 3A and 3B, in accordance with one or more embodiments of the present disclosure.

FIG. 3C is a close-up view of a grommet 202 and the one or more fabrics 328 of the multipocketed covering 106, in accordance with one or more embodiments of the present disclosure. Non-limiting examples of fabric which may be used to make up the one or more fabrics 328 include microfiber, neoprene, cloth, felt, wool, cotton, polyester, silk, velvet, denim, linen, chiffon, rayon, corduroy, leather, fleece, nylon, flannel, tarp, any combinations thereof, or any suitable material(s). The one or more fabrics 328 may be water-resistant or water-proof, heat-resistant, flexible, elastic, inelastic, or any materially feasible combination thereof. In some examples, the one or more fabrics 328 may be elastic, and in others, may be inelastic, or may have both elastic and non-elastic regions. Where used, elasticity of a section and/or pocket may allow each of the pockets 310 to securely fit around the heads of the golf clubs, such as by allowing the multipocketed covering 106 to stretch over larger heads of golf clubs 104 (e.g., drivers).

Figure 4:
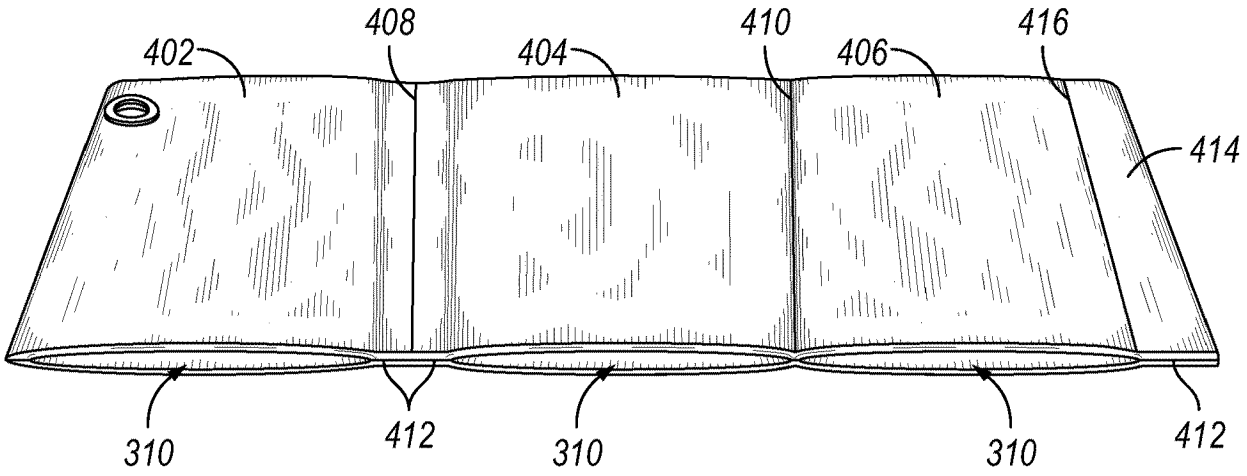
FIG. 4 is a side view of a multipocketed covering in accordance with one or more embodiments of the present disclosure.

FIG. 4 is a side view of a multipocketed covering 106 with three sections 402, 404, 406, in accordance with one or more embodiments of the present disclosure. Each section of the multipocketed covering 106 is depicted in this figure as having a corresponding pocket 310. As illustrated, the first section 402 adjoins the second section 404 by a first seam 408, and the second section 404 adjoins the third section 406 by a second seam 410. The seams 402, 410 may function to structurally support the multipocketed covering 106, and/or may also ensure proper fit around the golf clubheads 206 (e.g., referring to FIG. 2) in some examples. Also shown are bottom seams 412 adjacent to the openings 310 that are oriented perpendicularly to the first and second seams 408, 410. Any or all of seams 408, 410, 412 may be stitched, woven, sewn, knitted, glued, heat sealed, etc., as with seam 316 (e.g., referring to FIG. 3), or else substituted with a functionally equivalent method of joining the sections together, as previously discussed.

In the example shown, the openings of the pockets 310 are arranged in an alternating pattern, with an opening of the first section 402 biased to the left, an opening of the second section 404 biased to the right, and an opening of the third section 406 biased to the left. For multipocketed coverings comprising a greater number of sections, this alternating pattern may continue. As mentioned, other configurations are possible, such as centralized configurations, random configurations, offset configurations, or other suitable types of configurations. Alternatively, a section may not include bottom seams 412 such that the openings 310 extends all the way across each corresponding section 402, 404, 406, for example, all the way from seam 408 to seam 410 for the opening 310 of section 404 in the illustrated example. In use, the golf clubheads 206 (e.g., referring to FIG. 2) may be placed facing within the pockets 310 in any suitable fashion, e.g., facing away or towards each other.

As further illustrated in FIG. 4, some embodiments of the multipocketed covering 106 may have a seam allowance 404. A seam allowance 404 is extra fabric extending beyond a seam, e.g., seam 416. Similar seam allowance may be used in addition to, or instead of, seam allowance 404, such as at any of the edges of the multipocketed covering 106, and which may prevent an outer seam from unraveling in some examples. Where an edge comprises a fold, a seam allowance may be placed opposite the fold, for example. Such folds may be unseamed. Also, the seam allowance 414 may serve to further extend the length of the multipocketed covering 106, thereby possibly enhancing its function as a towel.

Figure 5:
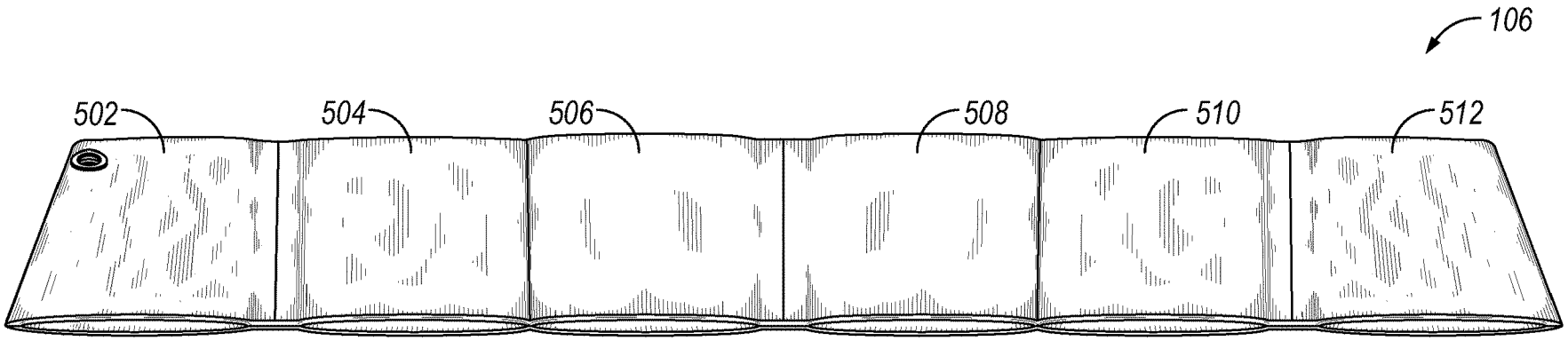
FIG. 5 is a side view of a multipocketed covering in accordance with one or more embodiments of the present disclosure.

FIG. 5 is a side view of a multipocketed covering 106 having six sections 502, 504, 506, 508, 510, and 512 to show the alternating pattern of FIG. 4, in accordance with one or more embodiments of the present disclosure. As shown, openings of each section may be biased in a left, right, left, right, etc., alternating pattern. Specifically, in the example shown, the openings of sections 504 and 506 are substantially close to each other, e.g., due to being divided by a vertical seam adjoining the two sections 504, 506. The openings 508 and 510 are also substantially close together, whereas the outer sections 502 and 512 have their openings placed towards the outermost edges of the multipocketed covering 106.

Figure 6:
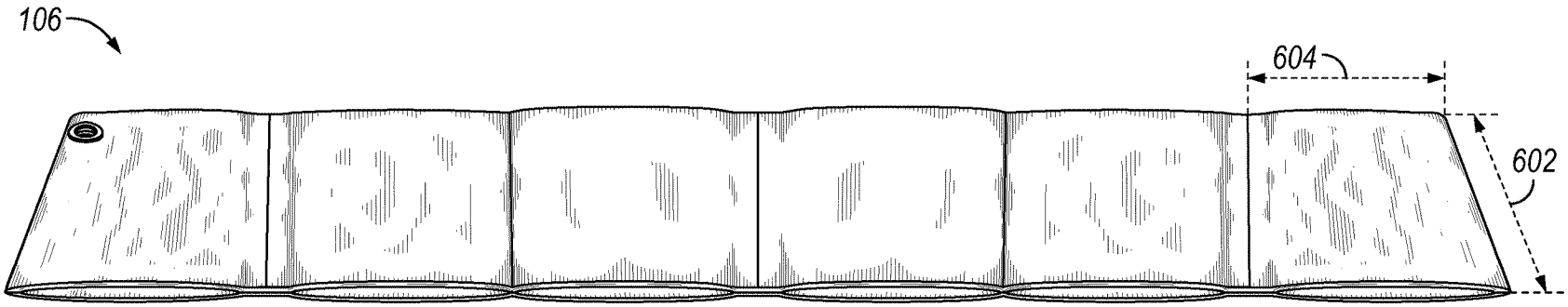
FIG. 6 is a side view of a multipocketed covering in accordance with one or more embodiments of the present disclosure.

FIG. 6 is a side view of the multipocketed covering 106 in accordance with one or more embodiments of the present disclosure. The multipocketed covering 106 is depicted in this figure as having six sections, e.g., with the sections in a 1 by 6 linear array. However, unlike FIG. 5 which begins (moving left-to-right) with a left-biased opening in a first section 502 followed by a right biased opening in a second section 504, this figure beings with a right-biased opening and is followed by a left-biased opening, such that the placement of the openings follows a right, left, right, left, etc., alternating pattern. Alternative embodiments may demonstrate different patterns of opening locations, such as centralized openings, as previously mentioned.

The dimensions of one or more, e.g., each, of the sections 502, 504, 506, 508, 510, 512, and/or sections of any of the preceding figures (e.g., FIGS. 3A, 4, 5, 6) may conform to the following descriptions. A section may have a vertical dimension 602 ("height") of about 5 inches (12.7 cm). Alternatively, from about 3 inches (17.78 cm) to about 7 inches (17.78), or any ranges therebetween, for example, about 4 inches (10.16 cm). A section may also have a horizontal dimension 604 ("width") of about 5 inches (12.7 cm). Alternatively, from about 4 inches (10.16 cm) to about 7 inches (17.78), or any ranges therebetween. The width of a section should be sufficient to engulf a golf clubhead, wedge, iron, etc., into the pocket corresponding to that section. Thus, the multipocketed covering 106 (e.g., referring to FIG. 1) may have a total horizontal dimension from about 8 inches (20.32 cm) to about 70 inches (177.8 cm), or any ranges therebetween, for example, depending on the number of sections included in the multipocketed covering 106. In one example embodiment, a multipocketed covering 106 may have six sections as shown, which may result in a total length of about 31 inches (78.74 cm), for example. Where used, a seam allowance 414 (e.g., referring to FIG. 4) may be about 0.5 inches (1.27 cm), for example, ranging from 0.1 inches (0.254) to 1 inches (2.54 cm) or any ranges therebetween, and may serve to extend the total length of the multipocketed covering 106.

Figure 7:
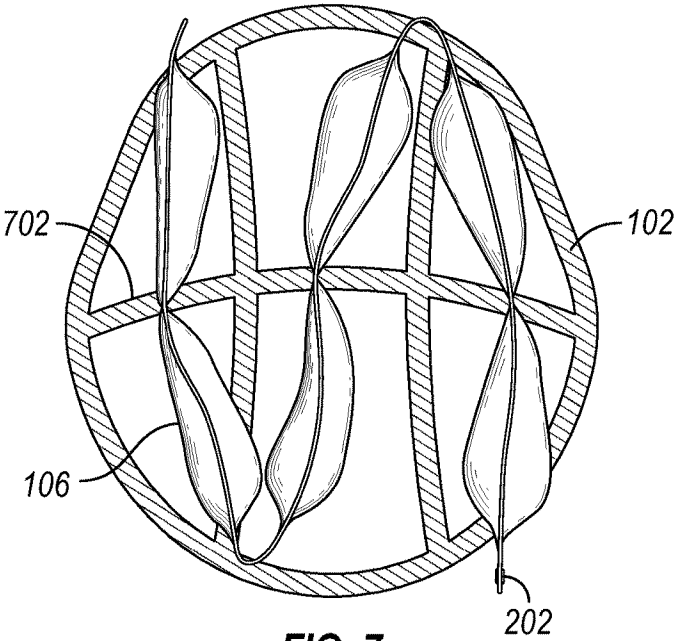
FIG. 7 is a top view of a multipocketed covering to show how it may be used to enclose at least a plurality of golf clubheads in a golf bag in accordance with one or more embodiments of the present disclosure.

FIG. 7 is a top view of the multipocketed covering 106 of FIG. 5 covering golf clubs disposed in a golf bag 102, in accordance with one or more embodiments of the present disclosure. As illustrated, the dividers 702 may be used to separate one or more of the golf clubs 104 (e.g., referring to FIG. 1) when disposed in the golf bag 102. The golf bag 102 may have any suitable number of dividers 702 and configurations thereof. For example, the golf bag 102 may be a 5-slot bag, a 7-slot bag, a 14-slot bag, etc., or any suitable number of slots. The multipocketed covering 106 is depicted in this figure with six sections, with each section corresponding to one of six golf clubs. As illustrated, the multipocketed covering 106 extends along a tortuous and meandering 'S' pathway so that it covers all six of the golf clubs. In this manner, each of the six golf clubs 104 depicted in this figure may be prevented from rubbing against one another.

Figure 8:
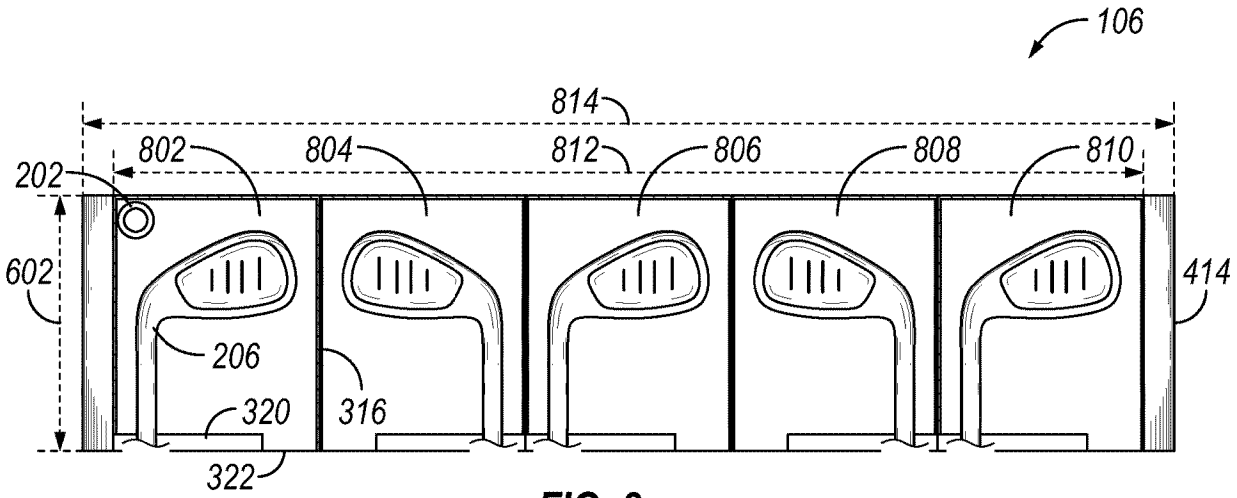
FIG. 8 is a side view of a multipocketed covering in accordance with one or more embodiments of the present disclosure.

FIG. 8 is a side view of a multipocketed covering 106 having five sections, in accordance with one or more embodiments of the present disclosure. In the example shown, multipocketed covering 106 has a first, second, third, fourth, and fifth section 802, 804, 806, 808, and 810. Each section has an opening 320, through which a golf clubhead 206 and optionally, at least a portion of a hosel and/or shaft of a golf club may be inserted. Each section is divided from the next by a seam 316, as previously mentioned. Each section may have a bottom seam 322, which may be adjoined to a bottom seam of a neighboring section at the seam 316, as shown. One or more seam allowances 414 may be disposed at any of the edges of the multipocketed covering 106, for example, at an outer edge of an outer most section 810. In this example, the vertical dimension 601 of each section is between 3 inches (7.62 cm) and 5 inches (12.7 cm), or any ranges therebetween. Thus, each section may have a width of about 5 inches (12.7 cm), and the multipocketed covering 106 may have a total length 814 of about 26 inches (66.04 cm). A total length 812 without including the seam allowance(s) 414 may be about 25 inches (63.5 cm). Also illustrated in this figure is the grommet 202, which is shown as being disposed at a top-left corner of the first section 802, but which may be disposed at any location of any of the sections of the multipocketed covering 106. In use, the multipocketed covering 106 may be folded along any of the seams, for example, at seam 316. These one or more folds allows the multipocketed covering 106 to extend across multiple sections of a golf bag 102 (e.g., referring to FIG. 7) in a tortuous, meandering manner such that each of a plurality of golf clubheads 106 are individually blanketed by the multipocketed covering to prevent frictional engagement between the golf clubheads 106.

Figure 9:
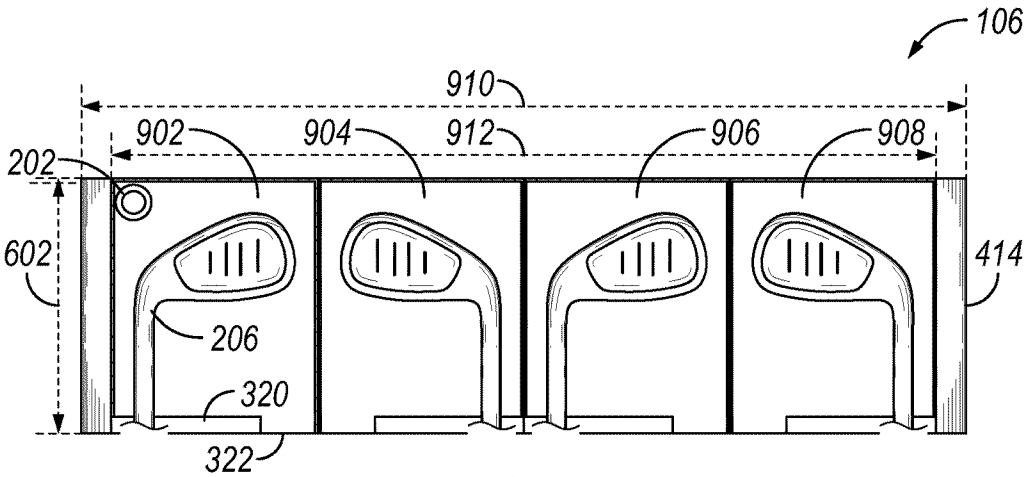
FIG. 9 is a side view of a multipocketed covering in accordance with one or more embodiments of the present disclosure.

FIG. 9 is a side view of a multipocketed covering 106 having four sections, in accordance with one or more embodiments of the present disclosure. In the example shown, multipocketed covering 106 has a first, second, third, and fourth section 902, 904, 906, and 908. As with FIG. 8, each section has an opening 320, through which a golf clubhead 206, and optionally, at least a portion of a hosel and/or shaft of a club, may be inserted. Each section is divided from the next by a seam 316. Each section may have a bottom seam 322, which may be adjoined to a bottom seam of a neighboring section at the seam 316, as shown. One or more seam allowances 414 may be disposed at any of the edges of the multipocketed covering 106, for example, at an outer edge of an outer most section 810. In this example, the vertical dimension 601 of each section is between 3 inches (7.62 cm) and 5 inches (12.7 cm), or any ranges therebetween. Thus, each section may have a width of about 5 inches (12.7 cm), and the multipocketed covering 106 in this example may have a total length 910 of about 21 inches (53.34 cm). A total length 912 without including the seam allowance(s) 414 may be about 20 inches (50.8 cm). Also illustrated in this figure is the grommet 202, which as with FIG. 8, is shown as being disposed at a top-left corner of a first section 902, but which may be disposed at any location of any of the sections of the multipocketed covering 106, for example, at any of sections 904, 906, or 908. As with previous figures, the multipocketed covering 106 may be folded along any of the seams, for example, at seam 316. As discussed, these one or more folds along at least a longitudinal length (e.g., seam 316) of the multipocketed covering 106 allows the multipocketed covering 106 to extend across multiple sections of a golf bag 102 (e.g., referring to FIG. 7) in a tortuous, meandering manner such that a plurality of golf clubheads 106 are individually blanketed by the multipocketed covering to prevent frictional engagement between the golf clubheads 106.

In one or more examples, the multipocketed covering of the present disclosure may be formed from a cloth or fabric, such as a cloth or fabric being about 10 inches (25.4 cm) by 36 inches (91.44 cm). This may allow a multipocketed covering to be folded along one edge and seamed at an opposite end. This may facilitate manufacture of the multipocketed covering, thereby allowing for a high rate of throughput during manufacturing of the multipocketed coverings in bulk. Alternatively, a cloth or fabric from which a multipocketed covering is formed may have a width greater than 10 inches and may have a width not less than 6 inches (15.24 cm) in some examples. In one or more examples, the multipocketed covering of the present disclosure may be configured to individually blanket and thus prevent frictional engagement between at least 2, at least 3, at least 4, at least 5, at least 6, at least 7, at least 8, or at least 14 clubs disposed within a golf bag 102 (e.g., referring to FIG. 7).

Alternative embodiments to the multipocketed coverings shown and described by the present figures may be, for example, a multipocketed covering with pockets arranged in a grid-like pattern rather than a linear configuration (e.g., a 1 by 6 linear configuration is shown in FIGS. 5, 6). For example, pockets and/or sections may be arrayed such as in a 2 by 2, 3 by 3, 2 by 3, 3 by 2, 2 by 6, 6 by 6, etc., configuration.

An example procedure for manufacturing the multipocketed covering is provided. A method may begin by providing one or more fabrics to be used to form the multipocketed covering. The one or more fabrics may comprise any suitable material, including any of those previously mentioned by this disclosure, and may have any suitable dimension sufficient to result in a multipocketed covering with the appropriate dimensions, for example, a 31 inch (78.74 cm) by 10 inch (25.4 cm) fabric may be provided. The fabric(s) may be folded, such as down a centerline of the fabric(s) to form a long pocket about 5 inches (12.7 cm) deep. The edges of the fabric(s) at either end of the long pocket, i.e., perpendicular to the fold, may be sewn shut. Then, the long pocket may be turned inside-out. This ensures, in some examples, that one or more seams are placed within the multipocketed such that they are hidden from the outside. Central seams (e.g., central seams 322, 412 of FIGS. 3A, 4) and vertical seams (e.g., seams 316, 408, 410 of FIGS. 3A, 4) may be added to the fabric(s) in any suitable order and may be added in such a way as to conform to any of the exemplary dimensional specifications for the sections of the multipocketed covering as previously described. One or more holes may be placed, e.g., punched, within the fabric(s) to make room for one or more hanging devices (e.g., grommet 202 of FIGS. 2, 3A, 3B, 3C). Placement of one or more holes may be performed before, after, or between any of the previous steps, for example, before, after or between any of folding and forming of a long pocket, sewing edges, placement of central, vertical, and/or other seams, etc. One or more hanging devices may then be placed within the one or more of the holes. For example, where a hanging device comprises a grommet, placement may comprise inserting a male and/or female end of a grommet on either side of the fabric(s) and applying pressure, e.g., hammering, the corresponding pieces together to secure the hanging device at an appropriate location of the multipocketed covering. Placement of a hanging device may additionally, or alternatively, comprise any of sewing, heat sealing, crimping, or other suitable technique.

Some advantages of the multipocketed covering of the present disclosure is a single apparatus having an ability to cover/protect multiple golf clubheads, such as by reducing or preventing the risk of frictional contact between them. The multipocketed covering may also protect the shaft(s) and/or hosel(s) of one or more of the golf clubs from the clubheads, especially when such shaft(s)/hosel(s) is/are made of graphite. In examples, the multipocketed covering may also function as a towel for cleaning, e.g., wiping dirt off golf balls, wiping sweat off face, etc., giving the multipocketed covering 106 dual function. This may remove or displace the need for additional golf towels.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Various advantages of the present disclosure have been described herein, but embodiments may provide some, all, or none of such advantages, or may provide other advantages.

What is claimed is:

1. A multipocketed covering comprising:

a first section comprising a first pocket disposed within one or more fabrics for receiving a first golf clubhead; and at least a second section comprising a second pocket disposed within the one or more fabrics for receiving a second golf clubhead, wherein the first section and the second section are adjoined between the first pocket and the second pocket, wherein the first and second sections are adjoined by at least one of one or more seams, fabric glue, heat bonding, fusible interfacing, sewing tape fabric tape, a hook-and-loop fastener, a snap, a button, a fabric rivet knotting, tying knitting, and any combination thereof, wherein the multipocketed covering is foldable along at least a length of the multipocketed covering by one or more folds, wherein the one or more folds allow the multipocketed covering to meanderingly extend across at least the first and the second golf clubs to prevent frictional engagement between at least the first golf clubhead and the second golf clubhead.

2. The multipocketed covering claim 1, further comprising at least one hanging device selected from the group consisting of a grommet, an eyelet, a snap, a buckle, a hook and loop fastener, a cloth loop, a clip, a button, and any combination thereof, wherein the at least one hanging feature is configured to hang the multipocketed covering from a corresponding mating feature of a golf bag.

3. The multipocketed covering of claim 2, wherein the hanging device is located at or near an edge of at least one section of the multipocketed covering.

4. The multipocketed covering of claim 1, wherein the one or more fabrics comprises a material that is capable of being folded and sewn.

5. The multipocketed covering of claim 4, wherein the one or more fabrics comprise at least one material selected from the group consisting of microfiber, neoprene, cloth, felt, wool, cotton, polyester, silk, velvet, denim, linen, chiffon, rayon, corduroy, leather, fleece, nylon, flannel, denim, tarp, and any combination thereof.

6. The multipocketed covering of claim 1, wherein the multipocketed covering is configured to house respective portions of at least one golf club selected from the group consisting of a wedge, a pitching wedge, a gap wedge, a sand wedge, a long iron, a putter, a hybrid, a fairway wood, and a driver, and any combination thereof.

7. The multipocketed covering of claim 1, wherein each section is at least 3 inches tall and at least 4.5 inches wide.

8. The multipocketed covering of claim 1, wherein each section is about 5 inches by about 5 inches.

9. The multipocketed covering of claim 1, wherein the multipocketed covering is folded at a top end and adjoined by a plurality of bottom seams at a bottom end opposite the top end.

10. The multipocketed covering of claim 1, further comprising one or more seams.

11. The multipocketed covering of claim 10, wherein at least one of the one or more seams is selected from the group consisting of a straight stitch, a backstitch, a blind stitch, a whip stitch, a buttonhole stitch, a cross-stitch, a chain stich, a zigzag stitch, a running stitch, a satin stitch, an overlock stitch, a lockstitch, a machine stitch, and any combinations thereof.

12. The multipocketed covering of claim 1, wherein openings to each pocket are centralized or offset in an alternating pattern relative to longitudinal centerlines of each corresponding section of the multipocketed covering.

13. The multipocketed covering of claim 1, wherein the one or more fabrics comprise at least one material that is substantially elastic.

14. The multipocketed covering of claim 1, wherein the one or more fabrics comprise at least one material that is substantially inelastic.

15. A method of manufacturing a multipocketed covering comprising:

folding one or more fabrics;

sewing the one or more fabrics;

after folding the one or more fabrics and at least partially sewing the one or more fabrics, punching one or more holes in the one or more fabrics; and placing one or more hanging devices at the one or more holes for hanging the multipocketed covering from a golf bag;

wherein the multipocketed covering comprises:

a first section comprising a first pocket disposed within one or more fabrics for receiving a first golf clubhead; and at least a second section comprising a second pocket disposed within the one or more fabrics for receiving a second golf clubhead, wherein the first section and the second section are adjoined between the first pocket and the second pocket, wherein the multipocketed covering is foldable along at least a length of the multipocketed covering by one or more folds, wherein the one or more folds allow the multipocketed covering to meanderingly extend across at least the first and the second golf clubheads to prevent frictional engagement between at least the first golf clubhead and the second golf clubhead.

16. The method of claim 15, wherein the sewing and folding the one or more fabrics forms a long pocket, wherein the method further comprises:

turning the long pocket inside out;

placing one or more seams along at least a portion of one or more edges of the long pocket while the long pocket is inside out; and placing one or more vertical seams between at least the first and the second section.

17. The method of claim 15, wherein the one or more hanging devices comprises at least one device selected from the group consisting of a grommet, an eyelet, a snap, a buckle, a hook and loop fastener, a cloth loop, a clip, a button, and any combination thereof.

18. The method of claim 15, wherein the first and second sections are adjoined by at least one joining technique selected from the group consisting of a straight stitch, a backstitch, a blind stitch, a whip stitch, a buttonhole stitch, a cross-stitch, a chain stich, a zigzag stitch, a running stitch, a satin stitch, an overlock stitch, a lockstitch, a machine stitch, fabric glue, heat bonding, fusible interfacing, sewing tape, fabric tape, a hook-and-loop fastener, a snap, a button, a fabric rivet, knotting, tying, knitting, and any combination thereof.

* * * * *